US010104977B2

(12) United States Patent
Li et al.

(10) Patent No.: US 10,104,977 B2
(45) Date of Patent: Oct. 23, 2018

(54) SOFA WAIST PROPING DEVICE

(71) Applicant: Remacro Machinery & Technology (Wujiang) Co., Ltd., Suzhou, Jiangsu (CN)

(72) Inventors: Xiaohong Li, Jiangsu (CN); Haibo Wang, Jiangsu (CN); Jiao Chen, Jiangsu (CN); Zhong Pang, Jiangsu (CN); Linlin Wu, Jiangsu (CN)

(73) Assignee: REMACRO MACHINERY & TECHNOLOGY (WUJIANG) CO., LTD., Suzhou (CN)

( * ) Notice: Subject to any disclaimer, the term of this patent is extended or adjusted under 35 U.S.C. 154(b) by 0 days.

(21) Appl. No.: 15/376,695

(22) Filed: Dec. 13, 2016

(65) Prior Publication Data

US 2018/0125247 A1 May 10, 2018

(30) Foreign Application Priority Data

Nov. 8, 2016 (CN) ..... 2016 1 0980652

(51) Int. Cl.

| | |
|---|---|
| ***A47C 1/02*** | (2006.01) |
| ***A47C 7/46*** | (2006.01) |
| ***A47C 17/04*** | (2006.01) |
| ***A47C 1/024*** | (2006.01) |
| *A47C 7/38* | (2006.01) |

(52) U.S. Cl.

CPC ..... *A47C 17/04* (2013.01); *A47C 1/0242* (2013.01); *A47C 1/0244* (2013.01); *A47C 7/46* (2013.01); *A47C 7/38* (2013.01)

(58) Field of Classification Search

CPC .... A47C 7/36; A47C 7/38; A47C 7/46; A47C 7/467; A47C 17/04; A47C 17/86; A47C 20/04; A47C 20/041; A47C 20/048; A47C 1/0242; A47C 1/0244

See application file for complete search history.

(56) References Cited

U.S. PATENT DOCUMENTS

| | | | | |
|---|---|---|---|---|
| 3,921,230 | A * | 11/1975 | Hanning | A47C 20/041 5/616 |
| 9,730,522 | B2 * | 8/2017 | Donovan | A47O 7/38 |
| 9,808,093 | B2 * | 11/2017 | Rawls-Meehan | A47O 20/08 |
| 9,826,841 | B2 * | 11/2017 | Donovan | A47O 7/462 |
| 9,861,204 | B2 * | 1/2018 | Lu | A47O 7/38 |
| 2004/0195895 | A1 * | 10/2004 | Sedlatschek | A47O 7/38 297/408 |
| 2016/0227934 | A1 * | 8/2016 | Lu | F16H 21/44 |

(Continued)

FOREIGN PATENT DOCUMENTS

| | | | | |
|---|---|---|---|---|
| CH | 328999 | A * | 4/1958 | A47C 20/048 |
| DE | 4211352 | A1 * | 10/1993 | A47C 20/041 |
| WO | WO-2016204837 | A1 * | 12/2016 | A47C 20/041 |

*Primary Examiner* — Ryan D Kwiecinski

(57) ABSTRACT

A sofa waist propping device includes a frame and a waist adjusting mechanism, the frame being fixed on a sofa or a seat, the waist adjusting mechanism comprising a backrest and a first driving member rotatably connected to the frame respectively, the first driving member being rotatably connected to the backrest and driving the backrest to rotate around the frame. Since the first driving member is rotatably connected to the backrest and drives the backrest to rotate around a fixing member, the position of the backrest is adjusted, with a structure simple and stable and comfortableness increased.

6 Claims, 3 Drawing Sheets

(56) References Cited

U.S. PATENT DOCUMENTS

| | | | | |
|---|---|---|---|---|
| 2016/0345740 | A1* | 12/2016 | Lu | A47O 7/38 |
| 2016/0361216 | A1* | 12/2016 | Liu | A47O 7/462 |
| 2016/0367033 | A1* | 12/2016 | Sigmon | A47O 1/02 |
| 2017/0208953 | A1* | 7/2017 | Shih | A47O 17/16 |
| 2017/0360201 | A1* | 12/2017 | Brown | A47O 1/0242 |
| 2018/0000253 | A1* | 1/2018 | Bellingroth | A47O 3/00 |
| 2018/0027979 | A1* | 2/2018 | Zhao | A47O 20/041 |

* cited by examiner

SOFA WAIST PROPING DEVICE

CROSS-REFERENCE TO RELATED APPLICATIONS

The present application claims the benefit of Chinese Patent Application No. 201610980652.5 filed on Nov. 8, 2016, the contents of which are hereby incorporated by reference.

FIELD OF THE INVENTION

The present invention relates to the field of sofa and seat, and more particularly, to a sofa waist propping device.

BACKGROUND OF THE INVENTION

With the improvement of people's living standards, the requirement for the comfortableness of sofa and seat is getting higher and higher. Although some sofas in the current market have a function of adjusting positions of the waist and the head, they have a complex structure and a high cost.

SUMMARY OF THE INVENTION

It is an object of the present invention to provide a sofa waist propping device capable of solving the problem of adjusting positions of the waist and the head, so as to overcome shortcomings of the prior art.

The object of the present invention is achieved by the following technical schemes.

A sofa waist propping device comprises a frame and a waist adjusting mechanism, the frame being fixed on a sofa or a seat, the waist adjusting mechanism comprising a backrest and a first driving member rotatably connected to the frame respectively, the first driving member being rotatably connected to the backrest and driving the backrest to rotate around the frame oppositely.

Preferably, the frame comprises a connecting member provided with a limit part, the backrest being rotatably connected to the connecting member and rotating around the connecting member, and the backrest being stopped from rotating by being brought into contact with the limit part.

Preferably, the connecting member further comprises two flat plates, the limit part being located outside of the two flat plates, the first driving member being rotatably connected to the inside of the two flat plates.

Preferably, the frame further comprises a fixing rod, the connecting member being fixed to the middle portion of the fixing rod to which the backrest is perpendicular and the first driving member is perpendicular, and the rotation angle of the backrest is 0° to 30°.

Preferably, the backrest comprises at least a rib and a backup plate, the rib being fixedly connected to the backup plate, the first drive member being rotatably connected to the connecting member at both ends of the rib.

Preferably, the first driving member comprises a driving source, the driving source being any one of an air cylinder, an oil cylinder, an electric cylinder or a motor.

Preferably, the sofa waist propping device further comprises a head adjusting mechanism comprising a second driving member, a headrest, and a headrest fixing member, the two ends of the second driving member being rotatably connected to the headrest fixing member and the connecting member respectively, the headrest fixing member being rotatably connected to the frame, and the second driving member driving the headrest to rotate around the frame.

Preferably, the headrest fixing member comprises at least one rotation limit member and a link rod, the at least one rotation limit member being fixed to the link rod.

Preferably, the frame further comprises at least one side fixing member, the at least one rotation limit member being provided with a rotation groove, the at least one side fixing member being provided with a convex platform which slides in the rotation groove such that the rotation angle of the headrest is limited to 0° to 45°.

Preferably, the frame further comprises a fixing rod, the connecting member being fixed to the middle portion of the fixing rod to which the headrest is perpendicular and the second driving member is perpendicular.

Compared with the prior art, the invention has the following advantages.

Since the first driving member is rotatably connected to the backrest and drives the backrest to rotate around a fixing member, the position of the backrest is adjusted, with a structure simple and stable and comfortableness increased.

Figure 1:
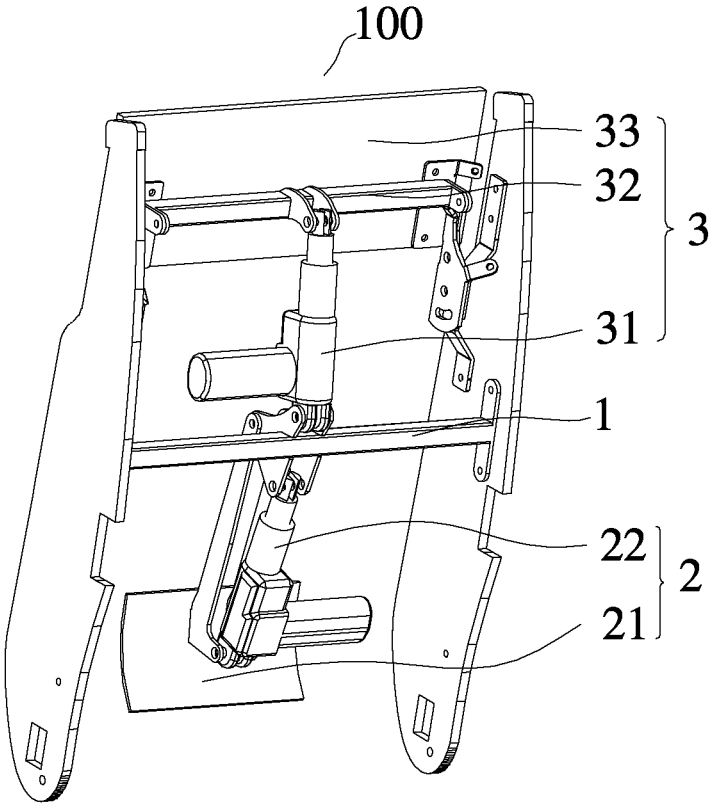
FIG. 1 is a perspective view of a sofa waist propping device according to the present invention.

100 Sofa waist propping device
1 Frame
11 Fixing rod
12 Connecting member
121 Limit part
13 Side fixing member
131 Convex platform
2 Waist adjusting mechanism
21 Backrest
211 Backup plate
212 Rib
22 First driving member
221 Driving source
222 Pushing rod
3 Head adjusting mechanism
31 Second driving member
32 Headrest fixing member
321 Rotation limit member
3211 Rotation groove
33 Headrest

DETAILED DESCRIPTION OF THE INVENTION

In the following, the invention will be further described in conjunction with the accompanying drawings and the detailed description.

Shown in FIG. 1 is a preferred embodiment of a sofa waist propping device 100 according to the present invention, and the sofa waist propping device 100 comprises a frame 1, a waist adjusting mechanism 2, and a head adjusting mechanism 3.

The frame 1 comprises a fixing rod 11, a connecting member 12, and two side fixing members 13. Both ends of the fixing rod 11 are fixed to a sofa, the connecting member 12 is fixed to the middle portion of the fixing rod 11, the connecting member 12 is provided with a limit part 121, each of the side fixing members 13 is fixed to a sofa and provided with a convex platform 131.

Figure 2:
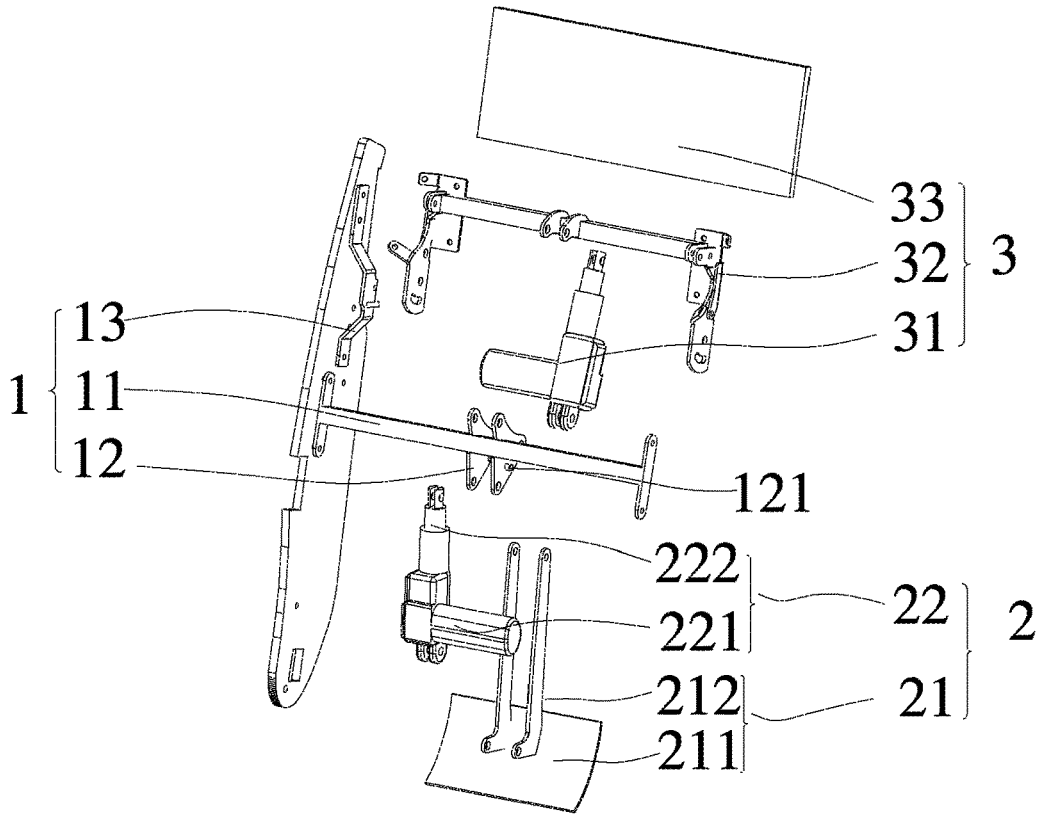
FIG. 2 is an exploded view of the sofa waist propping device shown in FIG. 1.
Figure 3:
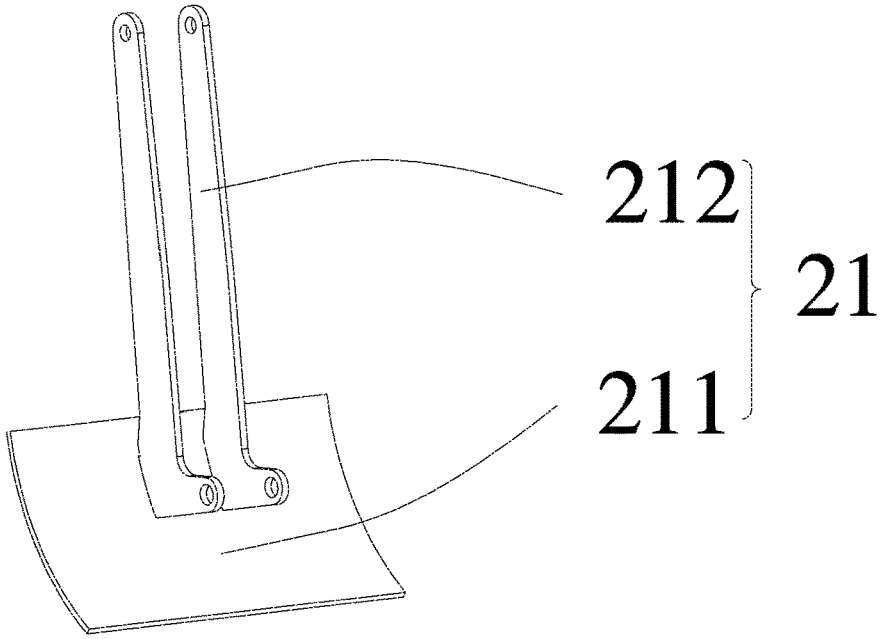
FIG. 3 is an exploded view of a backrest in the sofa waist propping device shown in FIG. 1.

As shown in FIGS. 2 to 3, the waist adjusting mechanism 1 comprises a backrest 21 and a first driving member 22. The backrest 21 and the first driving member 22 are rotatably connected to the connecting member 12 respectively, and the backrest 21 is rotatably connected to the other end of the first driving member 22. The backrest 21 comprises a backup plate 211 and two ribs 212, and each rib 212 is fixedly connected to the backup plate 211. The backup plate 211 is a concave plate and has same curve as the waist of a human body, having stable strength and high comfortableness. The first driving member 22 comprises a driving source 221 and a pushing rod 222, the drive source 221 is connected to the pushing rod 222 at one end and drives the pushing rod 222 to move, and preferably, the driving source 221 is one of a motor, a cylinder, an oil cylinder, and an electric cylinder.

Figure 4:
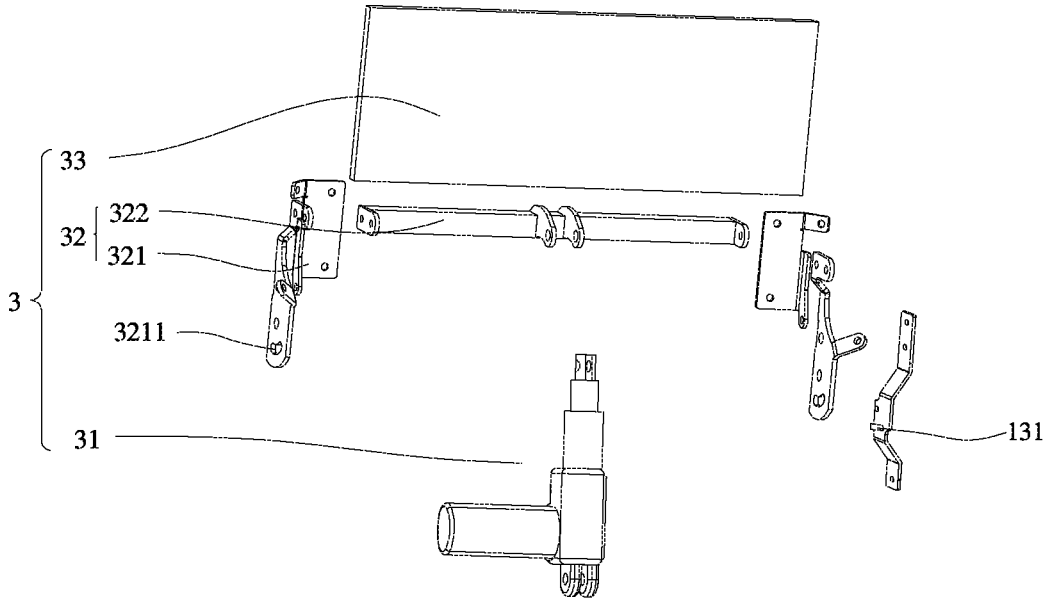
FIG. 4 is an exploded view of a head adjusting mechanism in the sofa waist propping device shown in FIG. 1.

As shown in FIG. 4, the head adjusting mechanism 3 comprises a second driving member 31, a headrest fixing member 32, and a headrest 33, the second driving member 31 is the same as the first driving member 22, two ends of the second driving member 31 are rotatably connected to the headrest fixing member 32 and the connecting member 12 respectively, the headrest fixing member 32 is rotatably connected to the side fixing member 13, and the headrest 33 is fixed to the headrest fixing member 32. The headrest fixing member 32 comprises two rotation limit members 321 and a link rod 322, and each of the rotation limit members 321 is fixed to the end of the link rod 322. The rotation limit member 321 is provided with a rotation groove 3211 which has a slightly larger diameter than that of the convex platform 131.

When the sofa waist propping device 100 is assembled, the two ends of the rib 212 of the backrest 21 are rotatably connected to the driving source 221 and one end of the connect member 12 respectively, one end of the pushing rod 222 is rotatably connected to the connecting member 12, the connecting member 12 is fixed to the middle portion of the fixing rod 11, the two ends of the second driving member 31 are rotatably connected to the headrest fixing member 32 and the connecting member 12 respectively, the rotation limit member 321 of the headrest fixing member 32 is rotatably connected to the side fixing member 13, the convex platform 131 slides in the rotation groove 3211 to limit the rotation angle of the headrest fixing member 32, so as to make the performance of the device more stable and safe, and preferably, the rotation angle is 0° to 45°.

When the waist propping device 100 is used, the driving source 221 drives the pushing rod 222, and drives the backrest 21 to rotate around the connecting member 12 to bring the backrest 21 to a desired angle. When the rib 212 of the backrest 21 is brought into contact with the limit part 121 of the connecting member 12, the initial position of the backrest 21 is arrived, and preferably, the rotation angle is 0° to 30°. The second driving member 31 drives the headrest fixing member 32 and the headrest 33 to rotate around the side fixing member 13 to bring the backrest 21 to a desired angle with smooth operation. The convex platform 131 of the side fixing member 13 slides in the rotation groove 3211 of the rotation limit member to limit the rotation angle of the headrest 33, and preferably, the rotation angle is 0° to 45°. The positions of the backrest 21 and the headrest 33 can be adjusted according to various conditions by the cooperation of the waist adjusting mechanism 2 and the head adjusting mechanism 3, with a structure simple and easy to use and sofa's comfortableness increased.

It will be apparent to those skilled in the art that various other changes and modifications may be made in the light of the above teachings and concepts, and all such changes and modifications are intended to be within the scope of the present invention as defined by the appended claims.

The invention claimed is:

1. A sofa waist propping device comprising a frame configured to be fixed to a sofa or a seat, a waist adjusting mechanism comprising a backrest and a first driving member rotatably connected to the frame respectively, the first driving member being rotatably connected to the backrest and driving the backrest to rotate around the frame;

wherein the frame comprises a connecting member provided with a limit part, the backrest being rotatably connected to the connecting member and rotating around the connecting member, and the backrest being stopped from rotating by being brought into contact with the limit part;

the connecting member further comprises two flat plates, the limit part being located outside of the two flat plates, the first driving member being rotatably connected to inside of the two flat plates.

2. The sofa waist propping device of claim 1 characterized in that the frame further comprises a fixing rod, the connecting member being fixed to a middle portion of the fixing rod to which the backrest is perpendicular and the first driving member is perpendicular, and a rotation angle of the backrest is 0° to 30°.

3. The sofa waist propping device of claim 1 characterized in that the first driving member comprises a driving source, the driving source being any one of an air cylinder, an oil cylinder, an electric cylinder or a motor.

4. The sofa waist propping device of claim 1 characterized in that the sofa waist propping device further comprises a head adjusting mechanism comprising a second driving member, a headrest, and a headrest fixing member, two ends of the second driving member being rotatably connected to the headrest fixing member and the connecting member respectively, the headrest fixing member being rotatably connected to the frame, and the second driving member driving the headrest to rotate around the frame.

5. The sofa waist propping device of claim 4 characterized in that the headrest fixing member comprises at least one rotation limit member and a link rod, the at least one rotation limit member being fixed to the link rod.

6. The sofa waist propping device of claim 5 characterized in that the frame further comprises at least one side fixing member, the at least one rotation limit member being provided with a rotation groove, the at least one side fixing member being provided with a convex platform which slides in the rotation groove such that a rotation angle of the headrest is limited to 0° to 45°.

* * * * *